United States Patent [19]

Barnes

[11] 4,452,360

[45] Jun. 5, 1984

[54] HANGER ASSEMBLY WITH U-SHAPED HANGER

[75] Inventor: Richard D. Barnes, Rockford, Ill.

[73] Assignee: Southern Imperial, Inc., Tupelo, Miss.

[21] Appl. No.: 245,314

[22] Filed: Mar. 19, 1981

[51] Int. Cl.[3] ..... A47F 5/08

[52] U.S. Cl. ..... 211/59.1; 248/222.2; 248/220.4; 403/353

[58] Field of Search ..... 211/57.1, 59.1, 54.1; 248/220.3, 220.4, 220.2, 221.1, 221.2, 222.2, 222.3, 73; 403/353

[56] References Cited

U.S. PATENT DOCUMENTS

| | | | |
|---|---|---|---|
| 2,386,129 | 10/1945 | Maack | 248/73 X |
| 2,917,813 | 12/1959 | Ackerman et al. | 403/353 X |
| 3,069,122 | 12/1962 | Babajoff | 248/221.2 |
| 3,241,799 | 3/1966 | Terlinde | 248/221.2 |
| 3,452,954 | 7/1969 | Lucietto et al. | 248/220.5 |
| 3,645,485 | 2/1972 | Gold | 211/59.1 X |
| 3,879,006 | 4/1975 | Staudte | 248/221.2 |
| 3,912,084 | 10/1975 | Valiulis | 211/57 |
| 4,258,892 | 3/1981 | Craine | 248/220.4 |
| 4,351,440 | 9/1982 | Thalenfeld | 211/57.1 |

FOREIGN PATENT DOCUMENTS

| | | | |
|---|---|---|---|
| 2386718 | 12/1978 | France | 211/59.1 |

*Primary Examiner*—Ramon S. Britts
*Assistant Examiner*—Robert W. Gibson, Jr.
*Attorney, Agent, or Firm*—Leydig, Voit, Osann, Mayer & Holt, Ltd.

[57] ABSTRACT

A hanger assembly includes a U-shaped hanger and a separate bracket for mounting the hanger on a perforated panel. The bracket is formed so as to enable the hanger to be quickly and easily attached to and detached from the bracket.

16 Claims, 12 Drawing Figures

HANGER ASSEMBLY WITH U-SHAPED HANGER

BACKGROUND OF THE INVENTION

This invention relates to a hanger assembly for supporting articles on a perforated panel of the type commonly referred to as a "Pegboard". Such an assembly includes a hanger adapted to project outwardly from the panel and adapted to hold merchandise. An exemplary hanger assembly is disclosed in Valiulis U.S. Pat. No. 3,912,084 in which the hanger is adapted to be releasably attached to the panel by a separate mounting bracket having a pair of horizontally spaced fingers which extend through holes in the panel. Several well known advantages are obtained when the hanger assembly includes a hanger and a separate mounting bracket.

The invention more specifically relates to a hanger assembly in which the hanger is generally U-shaped and is formed by upper and lower outwardly projecting arms whose inner ends are joined by an upright connector. The lower arm of such a hanger usually is used to hold merchandise while the upper arm supports a tag or the like having a price, a stock number and/or other indicia printed thereon.

SUMMARY OF THE INVENTION

The general aim of the present invention is to provide a new and improved hanger assembly having a U-shaped hanger and having a unique mounting bracket to which the hanger may be releasably but securely attached in a relatively quick and easy manner.

A more detailed object is to provide a hanger assembly having a separate mounting bracket which possesses the advantages of prior brackets of the same general type and which is uniquely formed to enable the U-shaped hanger to be connected releasably to the bracket.

In one embodiment, the invention resides in the provision of a plastic mounting bracket in which the connector of the hanger is received within holes in vertically spaced bosses which are formed with novel slots that permit the connector to be easily inserted into and held securely in the holes.

In another embodiment, the invention resides in the provision of a metal mounting bracket in which the connector of the hanger is received in and held by unique fingers.

These and other objects and advantages of the invention will become more apparent from the following detailed description when taken in conjunction with the accompanying drawings.

DETAILED DESCRIPTION OF THE PREFERRED EMBODIMENTS

Figure 2:
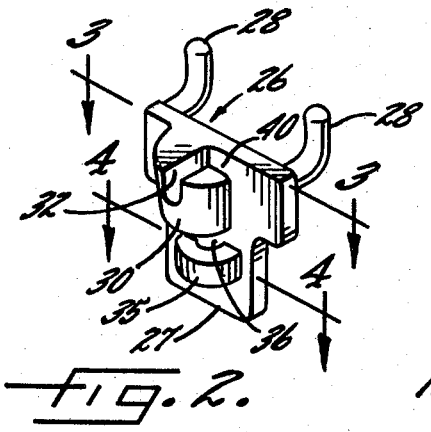
FIG. 2 is a perspective view of the mounting bracket shown in FIG. 1.

As shown in the drawings for purposes of illustration, the invention is embodied in a hanger assembly 10 having a hanger 11 for supporting one or more articles 13 from a panel or "Pegboard" 14 of the type formed with a series of vertically spaced and horizontally extending rows of holes 15. In this instance, the articles have been illustrated as being bags within which merchandise is contained. The upper end portion of each bag is formed with a hole to enable the bag to be hung from the hanger 11.

Figure 1:
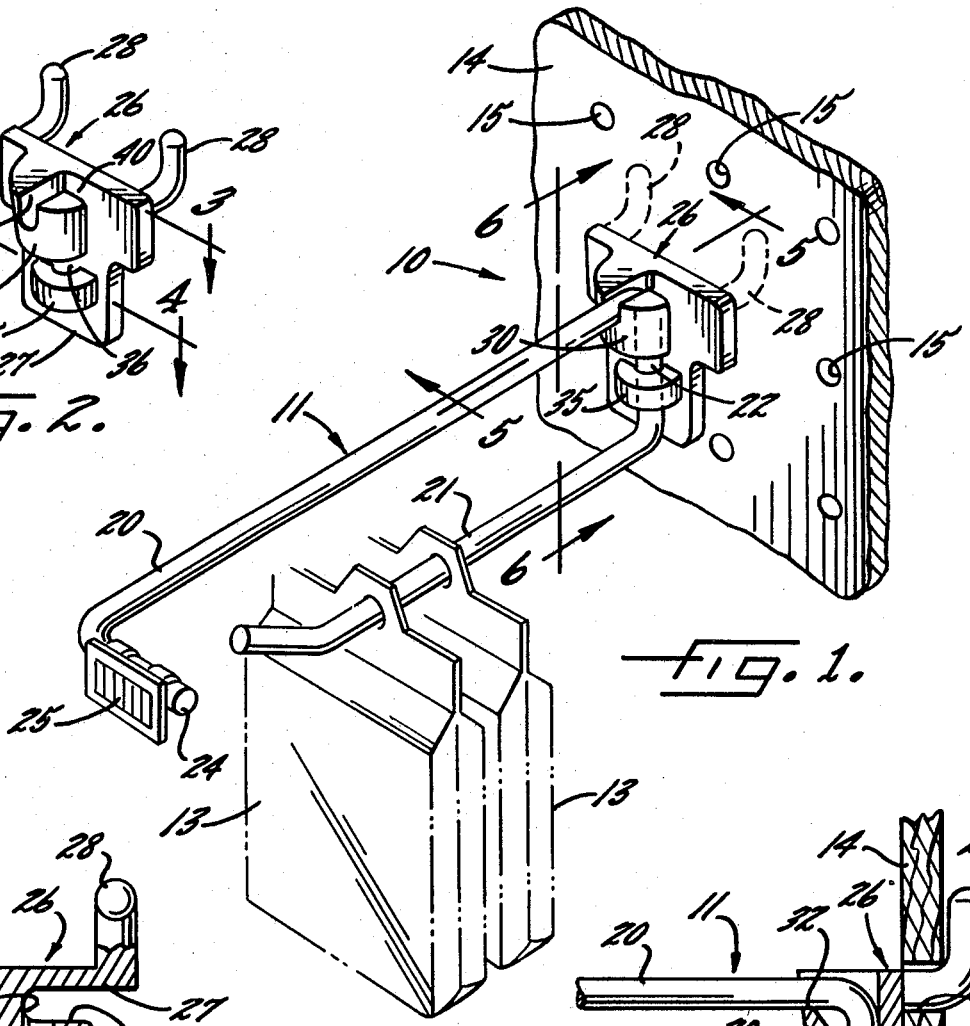
FIG. 1 is a perspective view showing a perforated panel and showing one embodiment of a new and improved hanger assembly incorporating the unique features of the present invention.

Herein, the hanger 11 is generally U-shaped and is made of round wire. The hanger includes upper and lower outwardly projecting arms 20 and 21 whose inner ends are formed integrally with and are joined by an upright connecting piece or connector 22. The lower arm supports the articles 13 while the outer end of the upper arm is formed with a laterally projecting finger 24 (FIG. 1). A tag 25 is supported by the finger and contains indicia such as a price, a stock number or the like which is adapted to be "read" by an electronic inventory wand.

The hanger assembly 10 further comprises a mounting bracket 26 for attaching the assembly releasably to the panel 14. In this instance, the bracket is molded of relatively rigid but resiliently yieldable plastic such as polypropylene or Delrin and includes a generally rectangular plate member 27 normally disposed in an upright plane and adapted to lie flat against the outer face of the panel. Molded integrally with the upper end portion of the plate and projecting inwardly from the inner face thereof are two fingers or horns 28, each horn having a horizontal portion located adjacent the plate and merging gradually with an upwardly projecting vertical portion. By turning the plate 27 to a horizontal position with the ends of the horns 28 pointing toward the panel 14 and by moving the plate edgewise, the normally vertical portions of the horns may be inserted into two horizontally spaced holes 15 in one of the horizontally extending rows of holes formed in the panel. Thereafter, the plate may be swung downwardly and toward the panel to cause the horizontal portions to enter the holes and to cause the vertical portions to engage and interlock with the rear face of the panel just above the holes (see FIG. 5).

In accordance with the present invention, the bracket 26 is uniquely constructed to enable the U-shaped hanger 11 to be quickly and easily attached to and detached from the bracket. In spite of such ease of attachment, the bracket holds the hanger securely and firmly on the panel 14.

Figure 3:
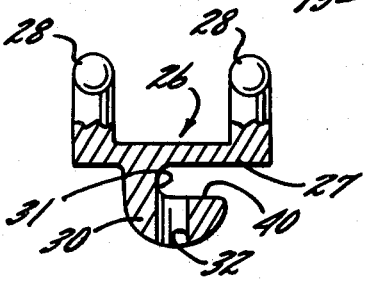
FIGS. 3 and 4 are cross-sectional views taken substantially along the lines 3—3 and 4—4, respectively, of FIG. 2.
Figure 6:
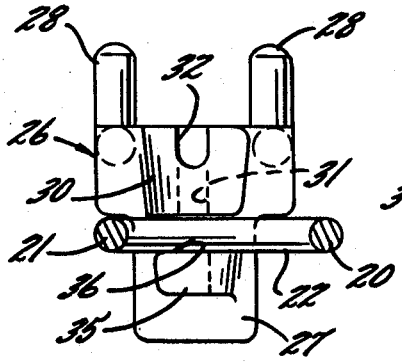
FIG. 6 is an enlarged fragmentary cross-sectional view taken substantially along the line 6—6 of FIG. 1 but shows the hanger in a turned position and being attached to the bracket.

In the preferred bracket 26 of the invention, an upright member or boss 30 of generally semi-circular cross-section is molded integrally with the outer side of the plate 27, the boss tapering downwardly and having an upper end located flush with the upper edge of the plate. A vertically extending hole 31 (FIG. 3) of circular cross-section is formed through the boss 30 and is sized to snugly receive the connector 22 of the hanger 11. Formed in the upper end portion of the boss is an upwardly opening and generally U-shaped notch 32 (FIGS. 2, 3 and 6) which extends from the outer side of the boss to the hole 31 therein. When the hanger 11 is attached to the bracket 26, the inner end portion of the upper arm 20 is received within the notch 32 and is captivated by the side walls thereof so as to prevent the hanger from swinging horizontally relative to the bracket and the panel 14.

Figure 4:
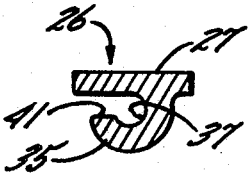

The preferred bracket 26 is formed with a second member or boss 35 which also is molded integrally with the outer side of the plate 27 and which is spaced below the boss 30. Thus, a forwardly and bilaterally opening gap 36 is defined between the upper and lower bosses 30 and 35, the height of the gap being just slightly greater than the diameter of the connector 22 of the hanger 11. A hole 37 (FIG. 4) for snugly receiving the connector is formed vertically through the boss 35.

In carrying out the invention, the bosses 30 and 35 are uniquely slotted to permit the connector 22 to enter into the holes 31 and 37. Specifically, a vertical opening or slot 40 (FIG. 3) is formed through one laterally facing side of the boss 30, extends throughout the entire height of the boss and communicates with the hole 31 therein. The inner side of the slot 40 is preferably but not necessarily defined by the outer side of the plate 27. When the plastic material of the bracket 26 is in a relaxed state, the width of the slot 40 is just slightly less than the diameter of the connector 22.

A second vertical opening or slot 41 (FIG. 4) extends throughout the entire height of the lower boss 35 but is formed through the opposite laterally facing side of the boss. The slot communicates with the hole 37 and has a width which is slightly less than the diameter of the connector 22 when the plastic material of the bracket 26 is relaxed. The inner side of the slot 41 is defined by the outer side of the plate 27.

Figure 5:
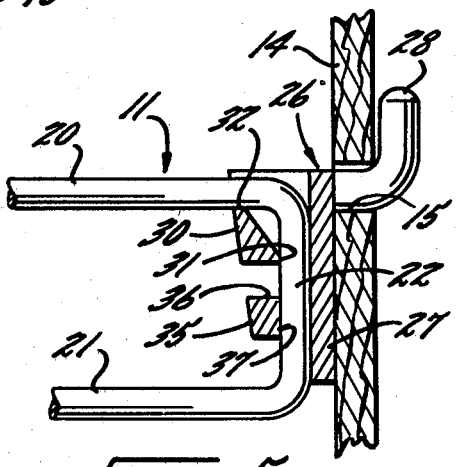
FIG. 5 is an enlarged fragmentary cross-sectional view taken substantially along the line 5—5 of FIG. 1.
Figure 7:
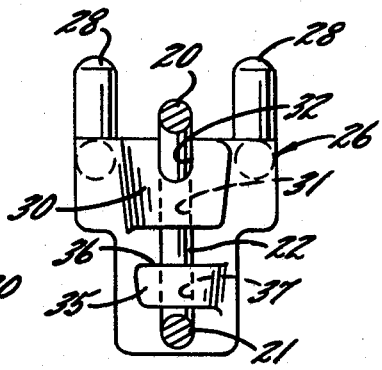
FIG. 7 is a view similar to FIG. 6 but shows a subsequent step of attaching the hanger to the bracket.

With the foregoing arrangement, the hanger 11 may be attached to the bracket 26 by gripping the arms 20 and 21 between the thumb and fingers of one hand and by positioning the hanger such that the connector 22 is horizontal with the arm 20 located to the right of the arm 21. The hanger then is moved endwise toward the bracket to cause the midportion of the connector 22 to enter the gap 36 between the bosses 30 and 35 (see FIG. 6). Thereafter, the hanger is simply turned in a counterclockwise direction to turn the connector 22 to a vertical position (see FIG. 7). As the connector approaches a vertical position, its upper end portion moves into the slot 40, cams the outer side wall of the slot outwardly and then passes through the slot and into the hole 31. At the same time, the lower end portion of the connector moves into the slot 41, cams the outer side wall of the slot outwardly and then passes through the slot and into the hole 37. Thereafter, the hanger is simply shifted downwardly to cause the inner end portion of the upper arm 20 to seat within the notch 32 as shown in FIGS. 1 and 5. A reverse procedure is followed to detach the hanger from the bracket.

When the hanger 11 is installed on the bracket 26, the side walls of the notch 32 prevent the hanger from swinging horizontally and frictionally restrict upward shifting of the hanger. The connector 22 is captivated between the plate 27 and the outer sides of the holes 31 and 37 and thus the hanger is prevented from swinging vertically and from shifting inwardly and outwardly. Lateral or sidewise shifting of the hanger is prevented by virtue of the connector 22 engaging laterally opposite sides of the holes 31 and 37. In addition, the resiliently yieldable bosses 30 and 35 grip the connector to prevent the hanger from cocking on the bracket.

Figure 8:
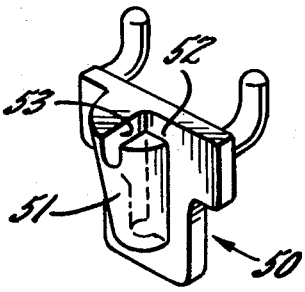
FIG. 8 is a perspective view of a second embodiment of a bracket.
Figure 9:
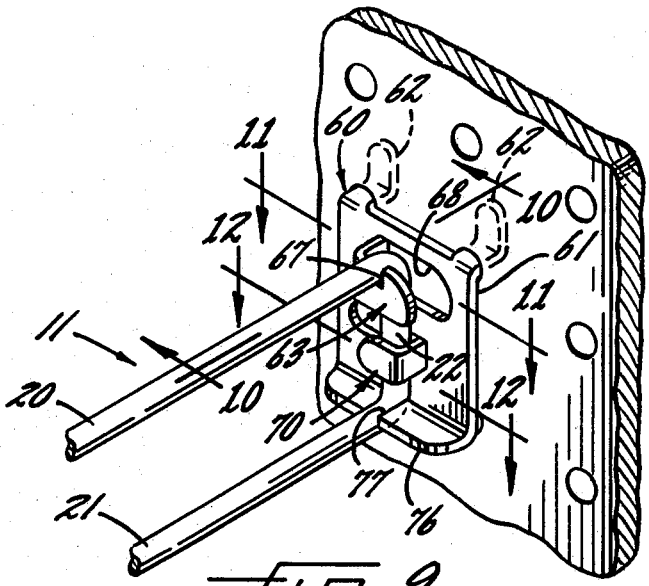
FIG. 9 is a view generally similar to FIG. 1 but shows yet another embodiment of a hanger assembly incorporating the features of the invention.
Figure 10:
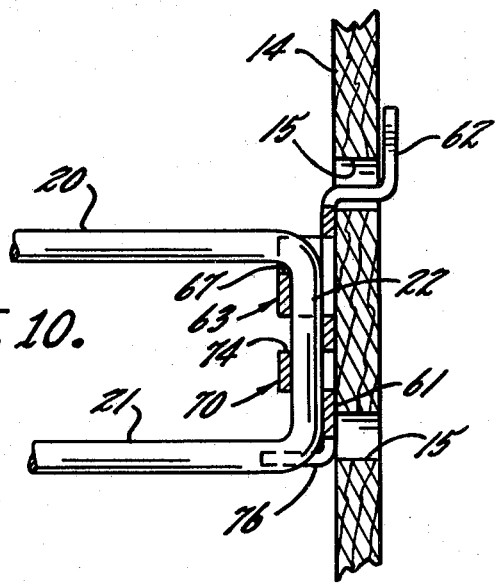
FIGS. 10, 11 and 12 are enlarged fragmentary cross-sectional views taken substantially along the lines 10—10, 11—11 and 12—12, respectively, of FIG. 9.

A modified bracket 50 is shown in FIG. 8. The bracket includes a single member or boss 51 whose height is just slightly less than the height of the connector 22. A vertical opening or slot 52 is formed in one laterally facing side of the boss and communicates with a vertical hole 53 which is formed through the boss. When the plastic of the bracket 50 is relaxed, the width of the slot is somewhat less than the diameter of the connector 22.

The hanger 11 is attached to the bracket 50 by holding the hanger such that the connector 22 is vertical and is positioned along the open side of the slot 52. The hanger then is shifted sidewise to cause the connector to move into the slot. As the connector enters the slot, it cams the outer side wall of the slot outwardly and then moves through the slot and into the hole 53. When the connector moves into the hole, the plastic material adjacent the outer side of the slot springs inwardly to captivate the connector in the hole and to restrict reverse sidewise shifting of the connector.

The bracket 50 is somewhat easier to mold than the bracket 26. It is, however, more difficult to attach the hanger 11 to and detach the hanger from the bracket 50 since a comparatively long length of plastic must be cammed outwardly with substantial force before the connector 22 can pass through the slot 52 and into the hole 53. Also, it is easier to apply force to the hanger 11 by turning the hanger as it is installed on the bracket 26 as opposed to shifting the hanger sidewise as it is installed on the bracket 50.

Another bracket 60 incorporating the features of the invention is shown in FIGS. 9 to 12 and, in this instance, the bracket is stamped from sheet metal. Thus, the bracket includes a metal plate 61 adapted to lie against the outer face of the panel 14 and formed with metal horns 62 adapted to be inserted into the holes 15 in the panel.

Figure 11:
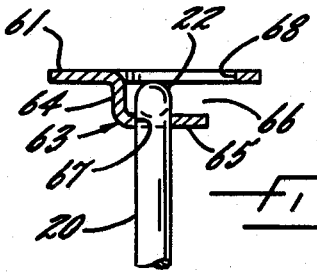
Figure 12:
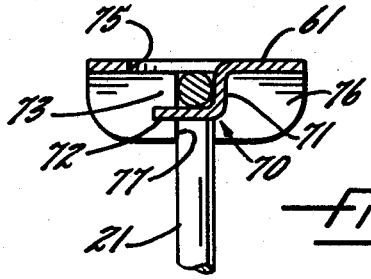

In keeping with the invention, a first member in the form of a substantially L-shaped finger 63 is struck outwardly from the upper end portion of the plate 61. As shown in FIG. 11, the finger 63 includes a first section 64 which projects outwardly from the plate 61 and further includes a second section 65 which projects laterally from the outer end portion of the first section. As a result, an opening 66 which opens upwardly and downwardly and which also opens laterally in one direction is difined between the second section 65 and the plate 61. An upwardly opening notch 67 (FIGS. 10 and 11) is formed in the upper edge portion of the second section 65 and is adapted to receive the upper arm 20 of the hanger 11. A hole 68 is left in the plate 61 as a result of the finger 63 being struck from the plate.

A second substantially L-shaped member or finger 70 is struck outwardly from the lower end portion of the plate 61 and also includes an outwardly projecting first section 71 (FIG. 12) and a laterally projecting second section 72. The first section 71 of the lower finger 70 is offset laterally from the first section 64 of the upper finger 63 while the second section 72 of the lower finger projects laterally in the opposite direction from the second section 65 of the upper finger. An opening 73 which opens upwardly, downwardly and laterally is defined between the plate 61 and the second section 72 of the lower finger 70 but such opening faces laterally in the opposite direction from the opening 66. The two fingers 63 and 70 are spaced vertically from one another and thus an outwardly and bilaterally opening gap 74 (FIG. 10) is defined between the fingers. A hole 75 (FIG. 12) is left in the plate 61 as a result of the finger 70 being struck from the plate.

The bracket 60 is completed by a lip 76 which is formed integrally with and which projects outwardly from the lower end portion of the plate 61. An upwardly, downwardly and outwardly opening recess or slot 77 is formed in the outer end portion of the lip 76 and is adapted to receive the lower arm 21 of the hanger 11.

The hanger 11 is attached to the bracket 60 in virtually the same way the hanger is attached to the bracket 26. That is, the hanger is positioned such that the connector 22 is horizontal and is disposed in the gap 74. Thereafter, the hanger is turned counterclockwise to cause the arms 20 and 21 to move into the openings 66 and 73, respectively, and to cause the arms to be captivated by the fingers 63 and 70. The hanger than is shifted downwardly to cause the arms 20 and 21 to enter the notch 67 and the slot 77, respectively, to prevent horizontal swinging of the hanger. Thus, the bracket 60 functions substantially the same as the bracket 26 but is capable of being stamped from sheet metal with relatively inexpensive tools.

I claim:

1. A hanger assembly adapted for attachment to an upright panel having horizontally spaced holes formed therethrough, said hanger assembly comprising a substantially U-shaped hanger having upper and lower arms adapted to project outwardly from the panel and having an upright connector extending between and joining the inner ends of said arms, said hanger assembly further comprising a mounting bracket for attaching said hanger to the panel, said bracket comprising an upright plate, a pair of horizontally spaced horns on the inner side of said plate and adapted to extend through two of said holes to attach the plate releasably to the panel either with or without the hanger attached to the bracket, a member located outwardly from said plate for receiving said connector, and an upright opening along one laterally facing side of said member and extending throughout the entire height thereof for removably attaching said hanger to said bracket by moving said connector through said opening and into said member, said hanger being detachable from said bracket by withdrawing said connector out of said member and through said opening.

2. A hanger assembly as defined in claim 1 in which said plate is made of plastic material, said member comprising a boss formed integrally with and projecting outwardly from said plate, said boss having a substantially vertical hole formed therethrough for receiving said connector, and said opening comprising an upright slot formed in one laterally facing side of said boss and communicating with said vertical hole throughout the entire height thereof.

3. A hanger assembly as defined in claim 2 further including a second boss projecting outwardly from said plate and spaced vertically from said one boss, a substantially vertical hole formed through said second boss for receiving said connector, and an upright slot formed in the opposite laterally facing side of said second boss and communicating with the hole in said second boss.

4. A hanger assembly as defined in claim 1 further including a second member located outwardly from said one member and spaced vertically from said one member, and an upright opening along the opposite laterally facing side of said second member and extending throughout the entire height thereof.

5. A hanger assembly as defined in claim 4 in which said plate is made of metal, said members comprising upper and lower vertically spaced and substantially L-shaped fingers struck from said plate, each of said fingers having a first section projecting outwardly from said plate and each having a second section projecting laterally from the outer end portion of the first section, the second section of the upper finger projecting laterally opposite from the second section of the lower finger.

6. A hanger assembly adapted for attachment to an upright panel having horizontally spaced holes formed therethrough, said hanger assembly comprising a substantially U-shaped hanger having upper and lower arms adapted to project outwardly from the panel and having an upright connector extending between and joining the inner ends of said arms, said hanger assembly further comprising a mounting bracket for attaching said hanger to the panel, said bracket comprising an upright plate, a pair of horizontally spaced horns on the inner side of said plate and adapted to extend through two of said holes to attach the plate releasably to the panel either with or without the hanger attached to the bracket, upper and lower vertically spaced members projecting outwardly from said plate for receiving said connector, an upright opening extending along the full height of one laterally facing side of said upper member, and an upright opening extending along the full height of one laterally facing side of said lower member, said upper and lower members in combination providing said upright openings in vertical alignment for removably receiving and attaching said connector to said bracket.

7. A hanger assembly as defined in claim 6 in which said openings extend along opposite laterally facing sides of said members.

8. A hanger assembly adapted for attachment to an upright panel, said hanger assembly comprising a substantially U-shaped hanger having upper and lower arms adapted to project outwardly from the panel and having an upright connector extending between and joining the inner ends of said arms, said hanger assembly further comprising a mounting bracket for attaching said hanger to the panel, said bracket comprising an upright plate, means on the inner side of said plate for attaching the plate releasably to the panel either with or without the hanger attached to the bracket, upper and lower vertically spaced bosses projecting outwardly from said plate and each having a substantially vertical hole formed therethrough for receiving said connector, there being an outwardly and bilaterally opening gap between said bosses, an upright slot formed in and extending through the full height of one laterally facing side of said upper boss and communicating with the hole therein, and an upright slot formed in and extending through the full height of the opposite laterally facing side of said lower boss and communicating with the hole therein for removably attaching said hanger to said bracket by placing said connector in said gap in a substantially horizontal position and by thereafter turning said connector to an upright position to cause said connector to pass through said slots and enter said holes, said hanger being detachable from said bracket by reversely turning said connector and withdrawing said connector from said holes through said slots.

9. A hanger assembly as defined in claim 8 in which said connector is made of round wire-like material and in which said bracket is made of plastic material, the distance between the inner and outer sides of each of said slots being slightly less than the diameter of said connector when said plastic material is in a relaxed condition.

10. A hanger assembly as defined in either of claims 8 or 9 in which the inner side of each of said slots is defined by the outer side of said plate.

11. A hanger assembly as defined in claim 8 further including an upwardly opening notch formed in the upper end portion of said upper boss and extending from the outer side of said upper boss to the hole in said upper boss, said notch being sized to receive the upper arm of said hanger to prevent said hanger from swinging horizontally.

12. A hanger assembly adapted for attachment to an upright panel, said hanger assembly comprising a substantially U-shaped hanger having upper and lower arms adapted to project outwardly from the panel and having an upright connector extending between and joining the inner ends of said arms, said hanger assembly further comprising a mounting bracket for attaching said hanger to the panel, said bracket comprising an upright plate, means on the inner side of said plate for attaching the plate releasably to the panel either with or without the hanger attached to the bracket, upper and lower vertically spaced and substantially L-shaped fingers on the outer side of said plate, there being an outwardly and bilaterally opening gap between said fingers, each of said fingers having a first section projecting outwardly from said plate and each having a second section projecting laterally from the first section whereby an opening is defined between said plate and each second section, and the second section of said upper finger projecting laterally opposite from the second section of said lower finger for removably attaching said hanger to said bracket by placing said connector in said gap in a substantially horizontal position and by thereafter turning said connector to an upright position to cause said connector to pass into said openings, said hanger being detachable from said bracket by reversely turning said connector and withdrawing said connector through said openings.

13. A hanger assembly as defined in claim 12 in which said plate is made from metal, said fingers being struck out from said plate.

14. A hanger assembly as defined in claim 12 in which the first section of said upper finger is offset laterally from the first section of said lower finger.

15. A hanger assembly as defined in claim 12 further including an upwardly opening notch formed in the upper edge portion of the second section of said upper finger, said notch being sized to receive the upper arm of said hanger to prevent the hanger from swinging horizontally.

16. A hanger assembly as defined in claim 15 further including a lip projecting outwardly from the lower end portion of said plate, and an upwardly and outwardly opening recess formed in said lip and sized to receive the lower arm of said hanger to prevent the hanger from swinging horizontally.

* * * * *